US006652118B2

(12) United States Patent
Shemitz et al.

(10) Patent No.: US 6,652,118 B2
(45) Date of Patent: Nov. 25, 2003

(54) ASYMMETRIC DISTRIBUTION LUMINAIRE

(75) Inventors: Sylvan R. Shemitz, Woodbridge, CT (US); Paul R. Ford, Orange, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 0 days.

(21) Appl. No.: 09/851,409

(22) Filed: May 8, 2001

(65) Prior Publication Data

US 2002/0003699 A1 Jan. 10, 2002

Related U.S. Application Data

(60) Provisional application No. 60/202,484, filed on May 8, 2000.

(51) Int. Cl.[7] ..... F21V 17/02

(52) U.S. Cl. ..... 362/225; 362/283; 362/285; 362/319

(58) Field of Search ..... 362/217, 219, 362/220, 225, 260, 283, 285, 319, 322, 301

(56) References Cited

U.S. PATENT DOCUMENTS

| | | | | | |
|---|---|---|---|---|---|
| 4,751,626 | A | * | 6/1988 | Plewman | 362/217 |
| 5,075,827 | A | | 12/1991 | Smith | |
| 5,117,342 | A | * | 5/1992 | Vlah | 362/217 |
| 5,777,857 | A | * | 7/1998 | Degelmann | 362/150 |
| 5,855,427 | A | | 1/1999 | Lassovsky | |
| 6,206,548 | B1 | * | 3/2001 | Lassovsky | 362/217 |

FOREIGN PATENT DOCUMENTS

| | | | | |
|---|---|---|---|---|
| DE | 33 16 000 | | 11/1984 | |
| DE | 3316000 | A1 * | 11/1984 | F21V/17/02 |
| DE | 4202768 | A1 * | 8/1993 | F21S/3/02 |
| DE | 42 10 605 | | 10/1993 | |
| EP | 0 194 590 | | 9/1986 | |
| EP | 0 408 402 | | 1/1991 | |
| FR | 2 711 219 | | 4/1995 | |
| GB | 2 082 744 | | 3/1982 | |
| GB | 2 214 285 | | 8/1989 | |

* cited by examiner

*Primary Examiner*—Sandra O'Shea
*Assistant Examiner*—John Anthony Ward
(74) *Attorney, Agent, or Firm*—Fish & Neave; Garry J. Tuma

(57) ABSTRACT

Linear luminaires that asymmetrically distribute emitted and reflected light are presented. These luminaires have single or twin unit fluorescent lighting and optional uplighting. Each includes an elliptical baffle assembly and at least one independently adjustable reflector enclosed within the housing of the luminaire. The adjustable reflector is adjustable through at least about 15° of rotation and is at least partially hidden from view by the housing and baffle assembly. The luminaires can be surface mounted, suspended, or cantilever mounted, and include wireways to permit wiring to be run discreetly inside and through adjacent asymmetric distribution luminaires.

14 Claims, 11 Drawing Sheets

ASYMMETRIC DISTRIBUTION LUMINAIRE

CROSS REFERENCE to RELATED APPLICATION

This claims the benefit of U.S. Provisional Application No. 60/202,484, filed May 8, 2000.

BACKGROUND of the INVENTION

This invention relates to linear luminaires having asymmetric light distribution. More particularly, this invention relates to linear luminaires having asymmetric light distribution that include internal adjustable reflectors.

Linear luminaires (e.g., fluorescent luminaires) that distribute light non-uniformly, that is, the intensity of the light emitted and reflected outward from the luminaire is not the same in all directions, some portions having is higher intensities than other portions, have asymmetric light distribution. Such light distribution allows a wall or ceiling to be evenly or uniformly "washed" (i.e., illuminated) by having light with the highest intensity directed to those portions of the wall or ceiling farthest from the luminaire.

A disadvantage of known linear asymmetrical distribution luminaires is that their reflectors are typically in a fixed position. Reflectors play an important role in aiming light produced by the luminaire. Thus, luminaires with fixed reflectors need to be positioned precisely in order to evenly wash a desired surface because once mounted, the aim of light is fixed. Many times, however, precise positioning is just not possible because of the way in which the luminaire is to be mounted or because of the luminaire locations available relative to the surface to be washed.

Moreover, although some known linear asymmetrical distribution luminaires have adjustable reflectors, none are known to have those adjustable reflectors enclosed within the luminaire's housing. Often, such external reflectors detract from the aesthetic appearance of the luminaire, which in many applications is very important.

Furthermore, it is not known whether any linear asymmetrical distribution luminaires with twin lighting units, such as those commonly used to light both sides of a hallway, have independently adjustable reflectors enclosed within the luminaire housing to allow light exiting on each side of the luminaire to be independently aimed.

In view of the foregoing, it would be desirable to be able to provide a linear asymmetric distribution luminaire having an adjustable reflector enclosed within the housing of the luminaire.

It would also be desirable to be able to provide a linear asymmetric distribution luminaire with twin lighting units having one or more independently adjustable reflectors enclosed within the housing of the luminaire.

SUMMARY of the INVENTION

It is an object of this invention to provide a linear asymmetric distribution luminaire having an adjustable reflector enclosed within the housing of the luminaire.

It is also an object of this invention to provide a linear asymmetric distribution luminaire with twin lighting units having one or more independently adjustable reflectors enclosed within the housing of the luminaire.

In accordance with this invention, a linear asymmetric distribution luminaire is provided that includes a housing having an aperture, a baffle assembly mounted to the housing over the aperture, an adjustable reflector mounted and enclosed within the housing, and an adjusting mechanism mounted within the housing and operative to adjust the reflector.

The present invention preferably includes a twin unit embodiment, each unit having an independently adjustable reflector mounted and totally enclosed within the luminaire's housing.

Advantageously, reflectors of the present invention can be adjusted without having to move or reposition the luminaire or luminaire housing. Furthermore, no other component or part of the luminaire needs to be removed in order to adjust the reflector.

Luminaires of the present invention include other features that further enhance the luminaire's versatility, such as, for example, easily removable and extendable baffle assemblies, through-wiring capabilities for side-by-side installation of continuous rows of luminaires, and optional uplighting.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
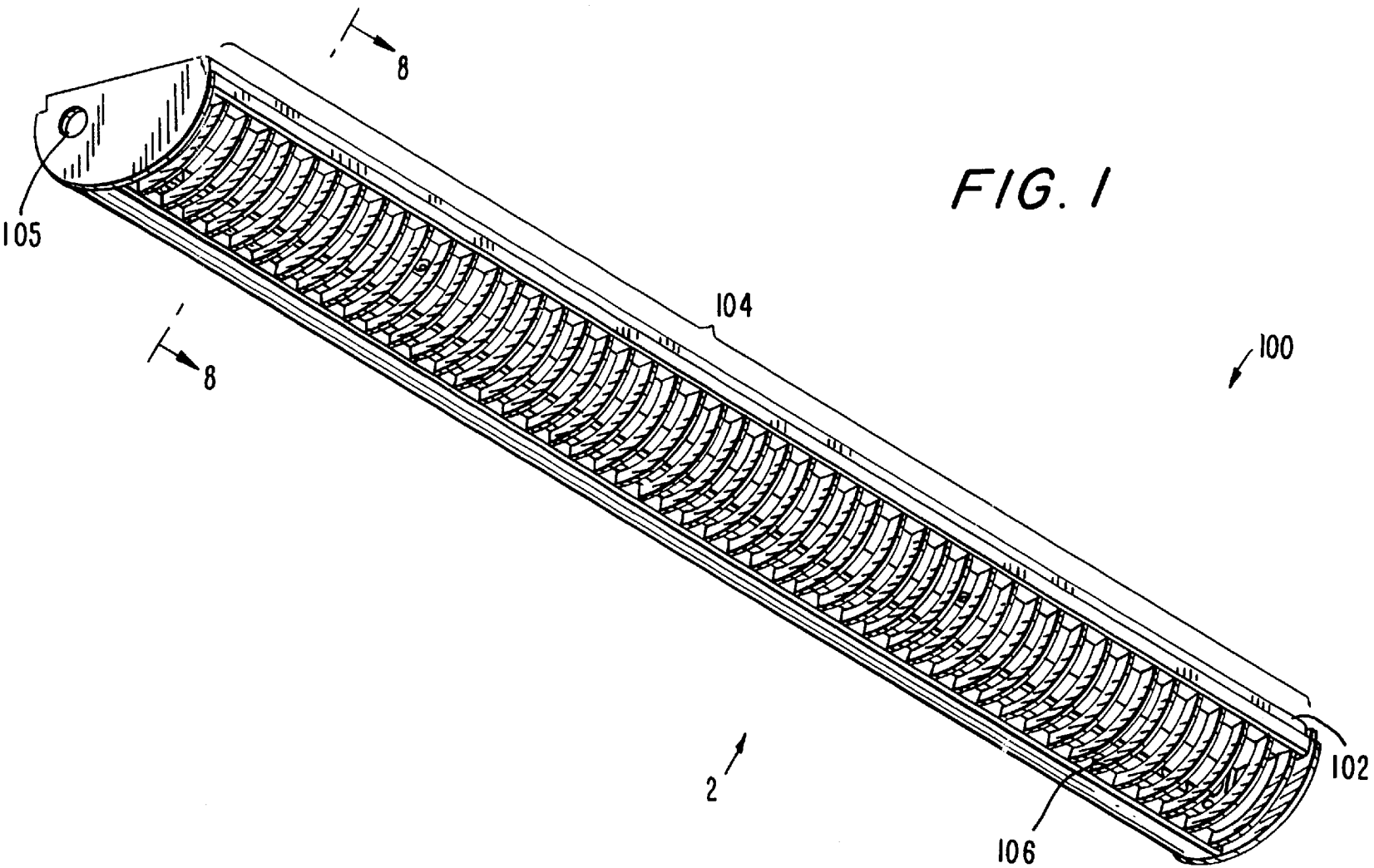
FIG. 1 is a perspective view of a single unit embodiment of an asymmetric distribution luminaire in accordance with the invention.
Figure 2:
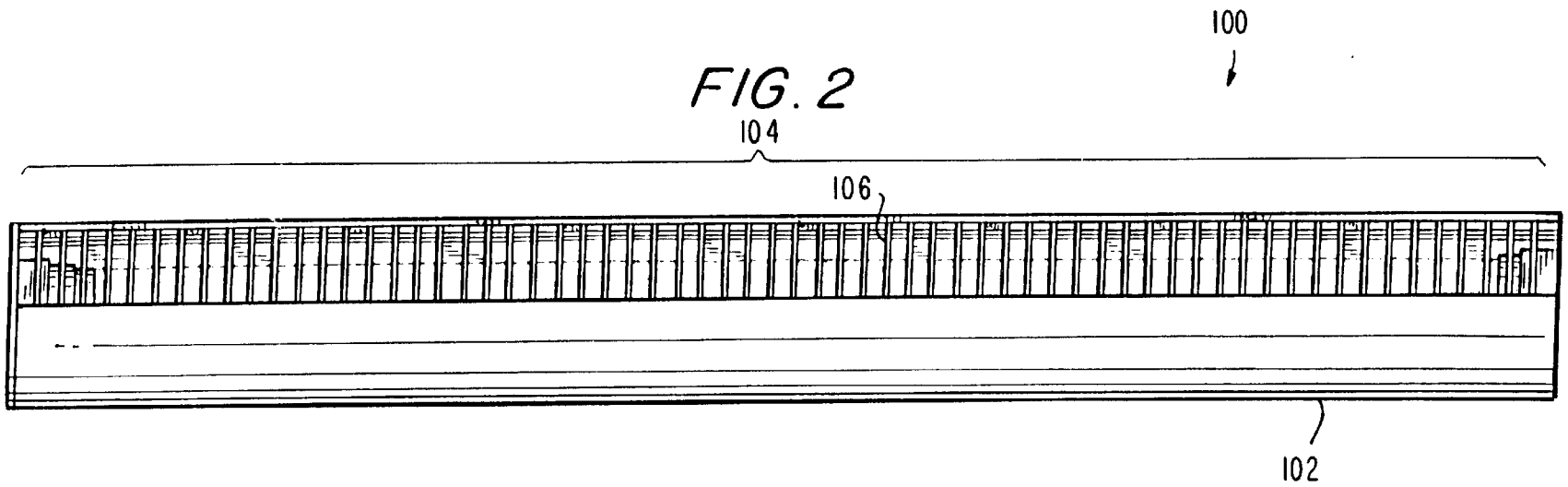
FIG. 2 is a plan view of the luminaire of FIG. 1 taken in the direction of arrow 2.

FIGS. 1 and 2 show an embodiment of a single-unit linear (e.g., fluorescent) asymmetric luminaire 100 according to the invention. Luminaire 100 includes a housing 102 having an aperture 104 along its longitudinal length and preferably an access hole 105 at preferably both longitudinal ends. Aperture 104 allows emitted and reflected light from inside housing 102 to pass outwardly there through. Access hole 105 can provide access to a power source and allows luminaire and other wiring to be routed there through to facilitate, for example, the installation of a continuous row of adjacent luminaires. Access hole 105 advantageously permits luminaire and other wiring to be discreetly run inside and through side-by-side luminaires, resulting in a safe operating environment (i.e., very little or substantially no exposed wiring) and an aesthetic appearance. Alternatively, access hole 105 can be a knockout. Housing 102 can also include other wiring access holes located, for example, along its upper flat portion.

Figure 3:
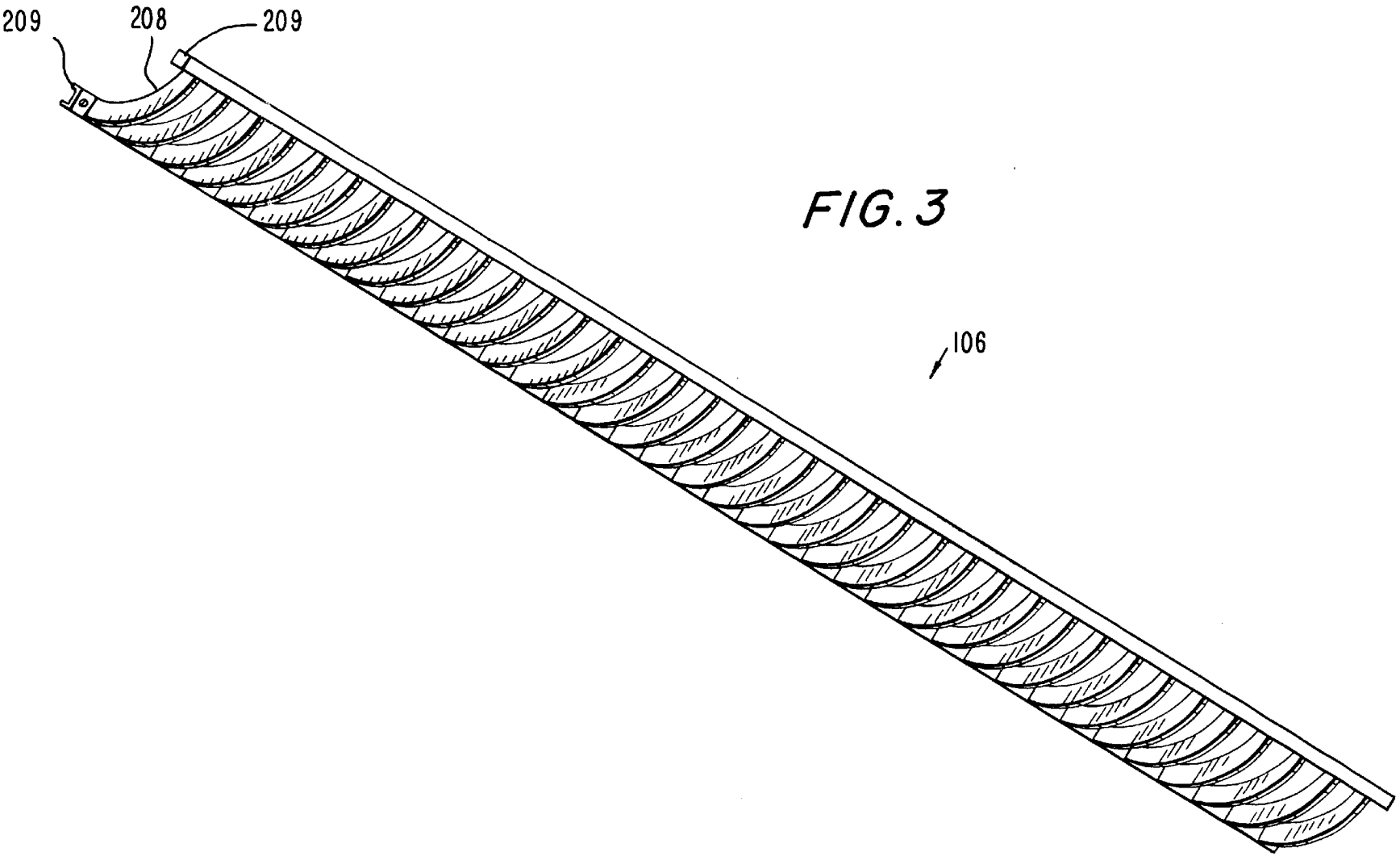
FIG. 3 is a perspective view of an embodiment of the baffle assembly of the luminaire of FIG. 1 in accordance with the invention.

Luminaire 100 preferably includes a preferably elliptical baffle assembly 106 mounted to housing 102 over aperture 104. As shown in FIG. 3, baffle assembly 106 is preferably a separate unit that preferably includes a plurality of parallel blades 208. Blades 208 may be, for example, flat or contoured. Also, blades 208 at each end of baffle assembly 106 are spaced from edges 209 preferably ½ the spacing between adjacent blades 208 to allow two baffle assemblies 106 to be installed adjacent to each other to provide uniform baffle blade spacing on longer luminaires having multiple baffle assemblies. Baffle assembly 106 provides longitudinal shielding from an observer's viewpoint of the internal brightness of the luminaire's lamp and reflector (described further below).

Figure 4:
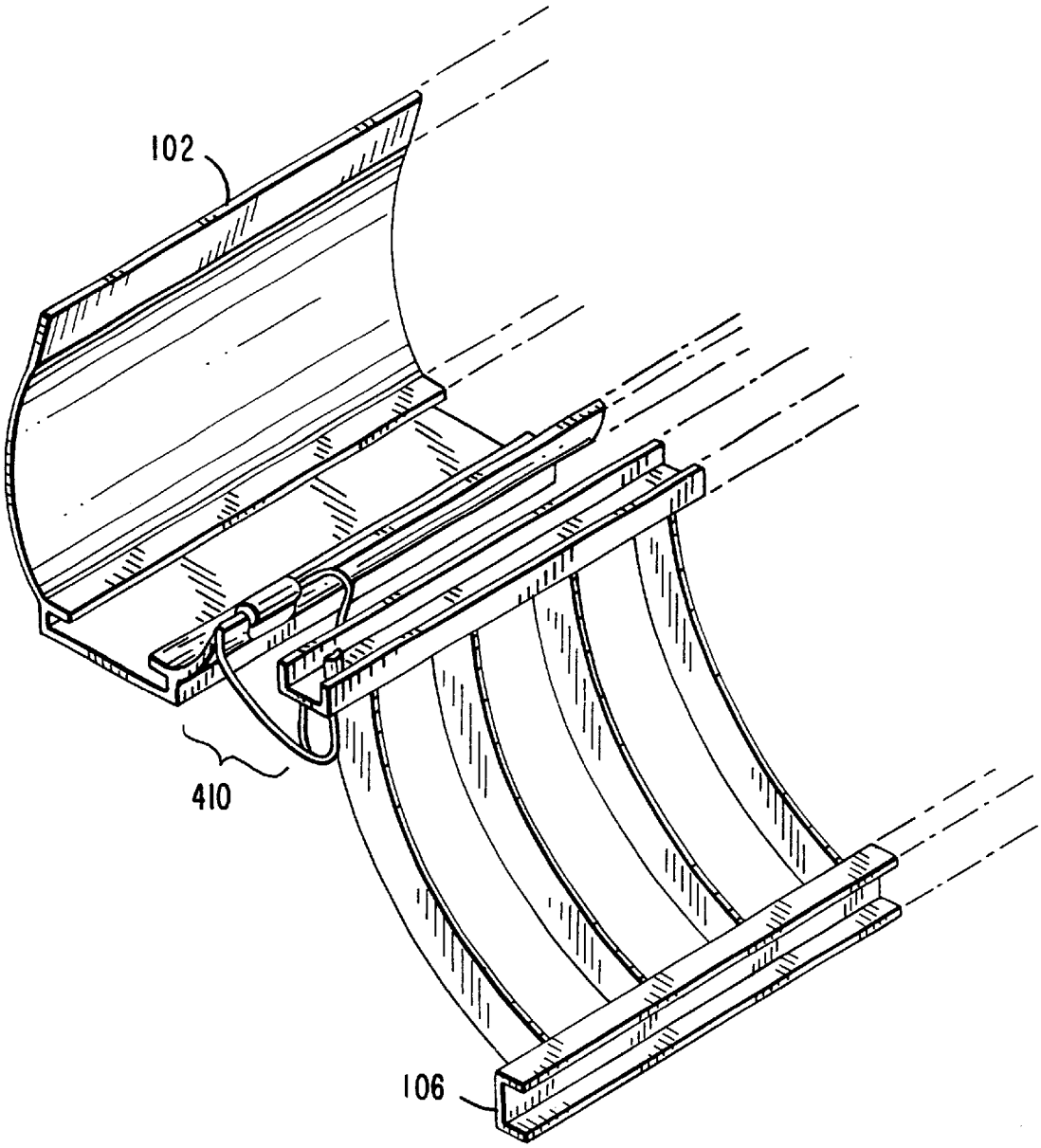
FIG. 4 is a partial perspective view of an embodiment of the baffle assembly mounted to the housing of the luminaire of FIG. 1 in accordance with the invention.

Baffle assembly 106 preferably mounts to housing 102 with a baffle retainer assembly 410 as shown in FIG. 4. By pushing up on baffle assembly 106, retainer assembly 410 allows the bottom edge of baffle assembly 106 to swing out. Retainer assembly 410 thus allows baffle assembly 106 to be easily removed without tools. Luminaire 100 can therefore be easily re-lamped, cleaned, serviced, etc.

Figure 5:
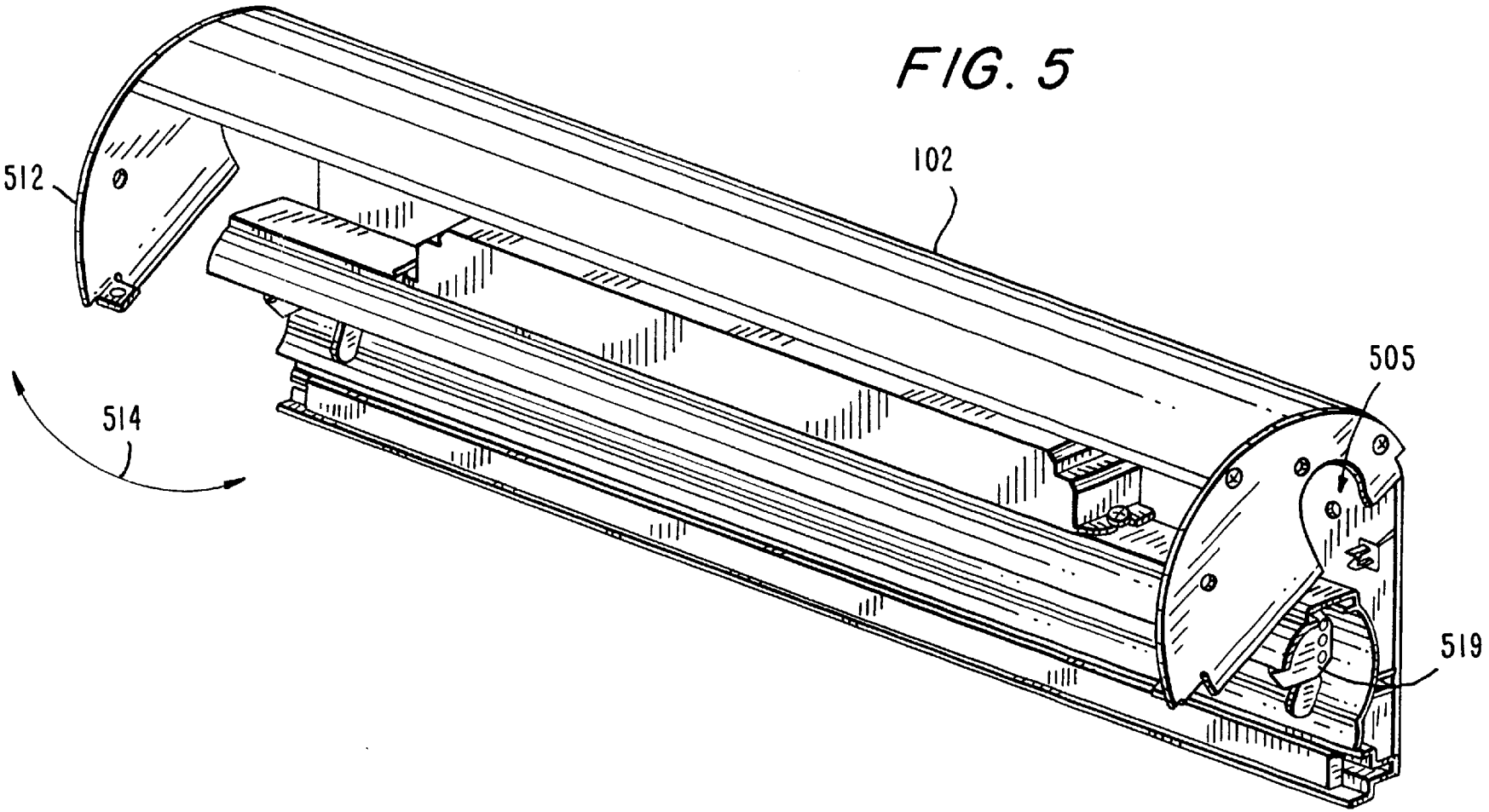
FIG. 5 is a perspective view of an embodiment of a housing of the luminaire of FIG. 1 in accordance with the invention.

Housing 102 preferably has a hinged section 512 that moves in the directions of arrow 514 to provide access to the inside of housing 102 as shown in FIG. 5. This is advantageous for installing, servicing, or replacing internal components such as, for example, ballasts, lamps, lampholders 519, wiring and wiring connections, etc.

Figure 7:
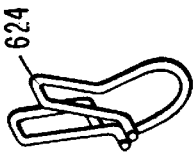
FIG. 7 is a perspective view of an embodiment of a lamp removal clip of the luminaire of FIG. 1 in accordance with the invention.
Figure 6:
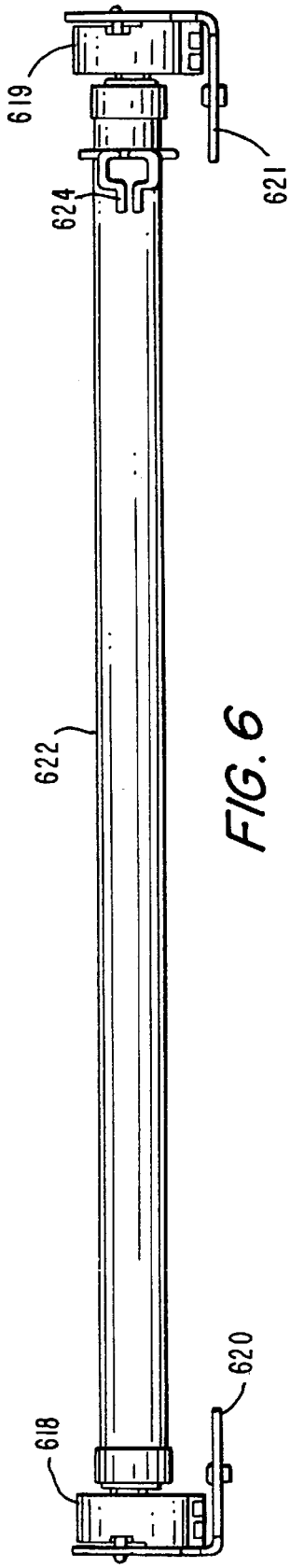
FIG. 6 is an elevational view of an embodiment of a lamp and lampholders of the luminaire of FIG. 1 in accordance with the invention.

FIG. 6 shows a pair of lampholders 618,619 and respective mounting brackets 620,621 holding a fluorescent lamp 622. Lampholders 618,619 are mounted within housing 102, and fluorescent lamp 622 is preferably a T-5 fluorescent lamp. Such fluorescent lamps have a ⅝" (1.6 cm) diameter, and are thus smaller than the traditional T12 fluorescent lamps, which have a 1.5" (3.8 cm) diameter, and the T8 fluorescent lamps, which have a 1" (2.5 cm) diameter. This allows the overall size of luminaire 100 to be much more compact than linear luminaires using larger diameter lamps. To facilitate installation and removal of fluorescent lamp 622, at least one lamp removal clip 624 is preferably included in luminaire 100. FIG. 7 shows another view of lamp removal clip 624.

Figure 8A:
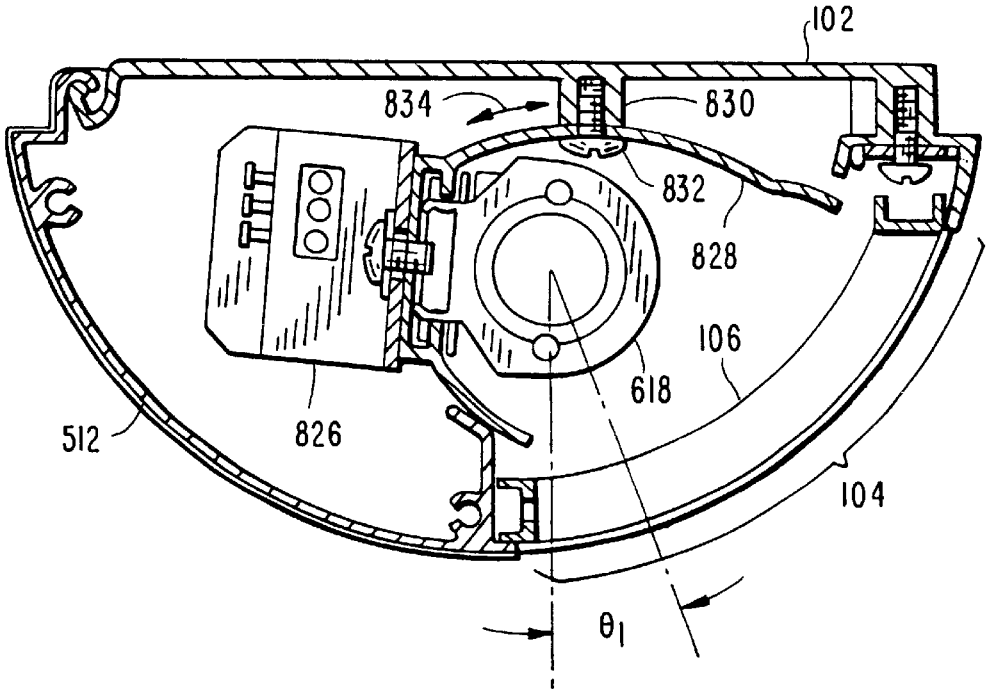
FIGS. 8A–B are cross-sectional views of the luminaire of FIG. 1 taken along line 8—8.
Figure 8B:
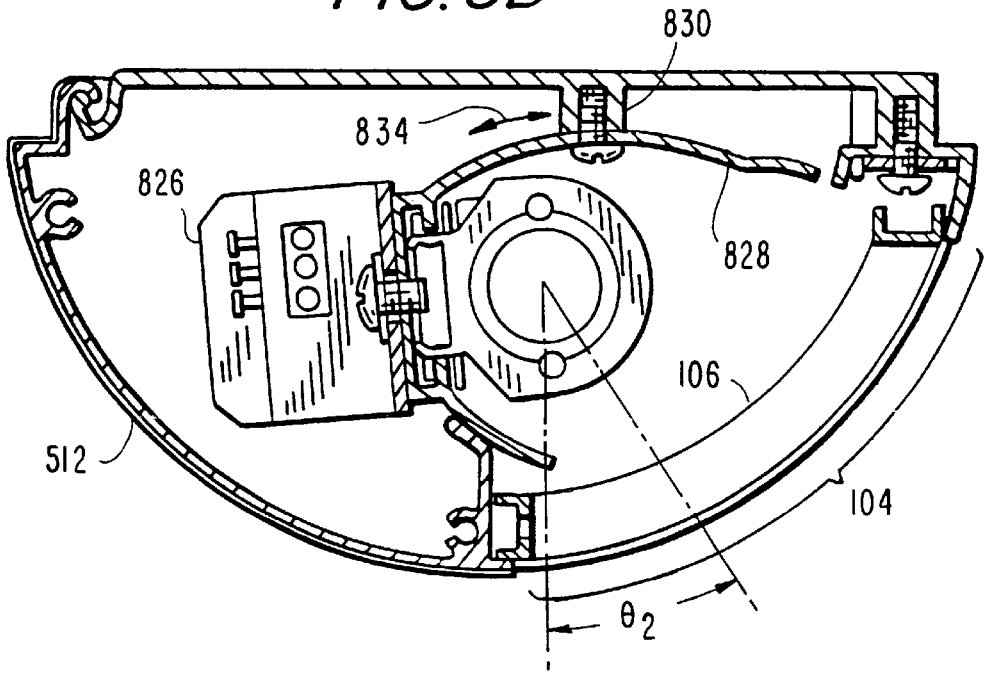

As shown in FIGS. 8A–B, luminaire 100 also includes a preferably electronic ballast 826, an adjustable reflector 828, and an adjusting mechanism 830 mounted within housing 102 according to the invention. Adjustable reflector 828 is preferably totally enclosed within housing 102 and is for the most part hidden from view by housing 102 and baffle 106. Advantageously, reflector 828 can be adjusted without having to remove any other components or parts of luminaire 100 and without having to move housing 102 or the mounting position of luminaire 100. Reflector 828 is adjustable preferably by loosening screw 832 and then moving the reflector in one of the directions of arrow 834 via a slot preferably milled in the reflector. This reflector movement can be described as being about a longitudinal axis that runs substantially parallel to the longitudinal axis of reflector 828. Upon loosening screw 832, reflector 828 can be moved, for example, by merely pushing against an edge of reflector 828 with, for example, a screwdriver. A screwdriver, or other similar tool, could also be used to move reflector 828 by inserting that tool in an optionally provided slotted hole on reflector 828 (not shown). Alternatively, other suitable adjusting mechanisms can be used, such as, for example, a hinge or pivot mechanism.

The degree of adjustability of reflector 828 is preferably at least about 15°. FIGS. 8A–B illustrate angles θ1 and θ2, which represent zones of outputted light from luminaire 100 having the highest intensity (i.e., candlepower). Angle θ1 is preferably about 20° (and is conventionally measured from nadir, generally accepted to be in a direction vertically downward), while angle θ2 is about 35°, which represents about a 150 adjustable window controlled by reflector 828. The degree of adjustability can be alternatively less than or greater than the preferred 150 window. The maximum degree of adjustability is limited by either the angular size of aperture 104, which as shown is almost about 100°, the size of reflector 828 relative to its spacing from housing 102 and baffle 106, or the manner in which ballast 826 is mounted within housing 102, and if mounted to reflector 828 as shown, the ballast's spacing from housing 102.

Light emitted and reflected outward from luminaire 100 through aperture 104 is asymmetrically distributed such that, for example, vertical or horizontal surfaces can be uniformly "washed" with light, the highest intensity light being aimed near the portion of the washed surface farthest away from the luminaire. Luminaire 100 also can be advantageously positioned to distribute light downwards, upwards, or sideways. Moreover, the adjustable reflector permits the highest intensity light (i.e., light having maximum candlepower) to be variably aimed.

Figure 9:
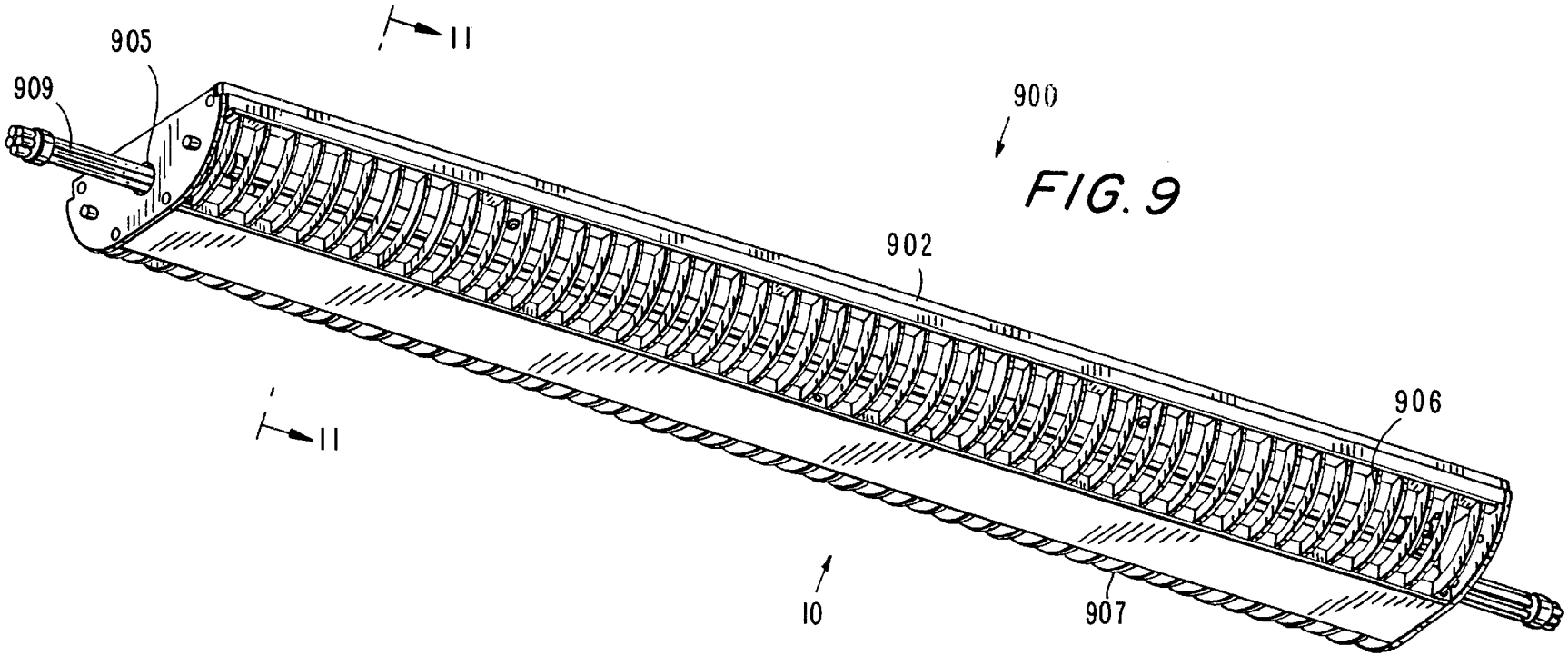
FIG. 9 is a perspective view of a twin unit embodiment of an asymmetric distribution luminaire in accordance with the invention.
Figure 10:
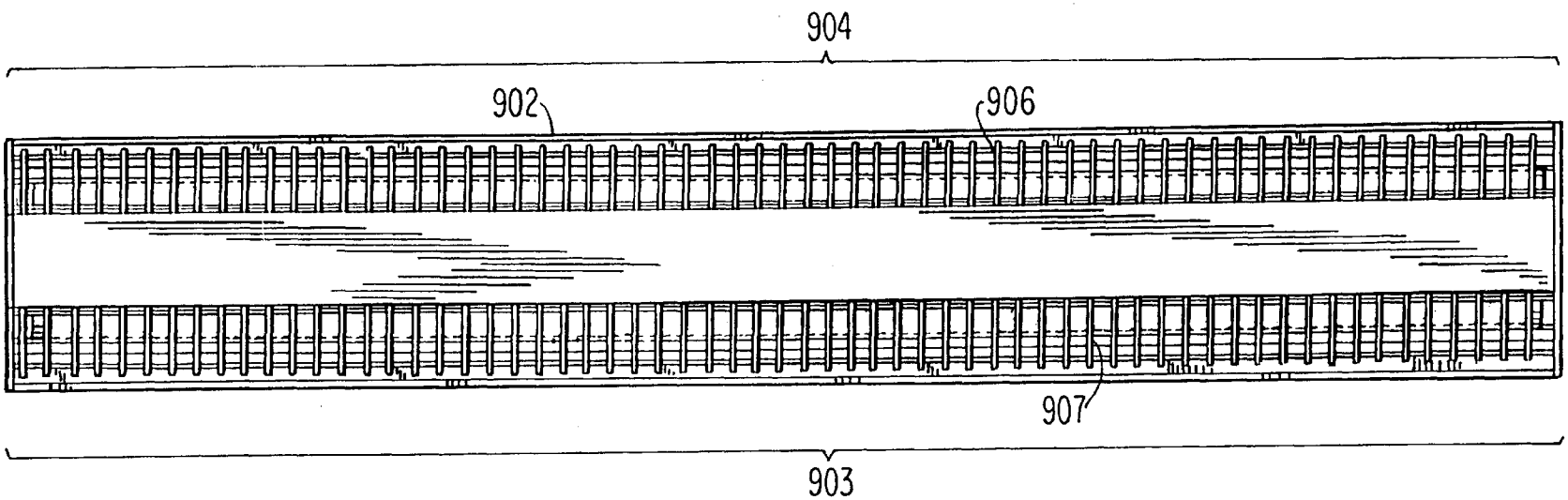
FIG. 10 is a plan view of the luminaire of FIG. 9 taken in the direction of arrow 10.

FIGS. 9 and 10 show a twin-unit embodiment of a linear asymmetric distribution luminaire 900 in accordance with the present invention. Luminaire 900 is particularly advantageous for downward washing of vertical surfaces and includes two back-to-back lighting units each with a separate, preferably independently adjustable reflector preferably totally enclosed within a housing 902. Housing 902 has an aperture 903, an aperture 904, and an access hole 905. Apertures 903 and 904 permit light to exit from each respective side of luminaire 900. Access hole 905, which can alternatively be a knockout, permits wiring to be routed there through to facilitate, among other things, sideby-side installation of luminaires of the present invention. Preferably, luminaire 900 includes modular through-wiring harnesses 909 with quick connectors to further facilitate installation and powering of side-by-side luminaires. Such modular through-wiring harnesses and quick connectors are also optionally included in luminaire 100.

Luminaire 900 also preferably includes preferably elliptical baffle assemblies 906 and 907 mounted to housing 902 and respectively positioned over apertures 904 and 903. Baffle assemblies 906 and 907 each preferably include a plurality of parallel blades and can be the same as, or similar to, baffle assembly 106.

Figure 11:
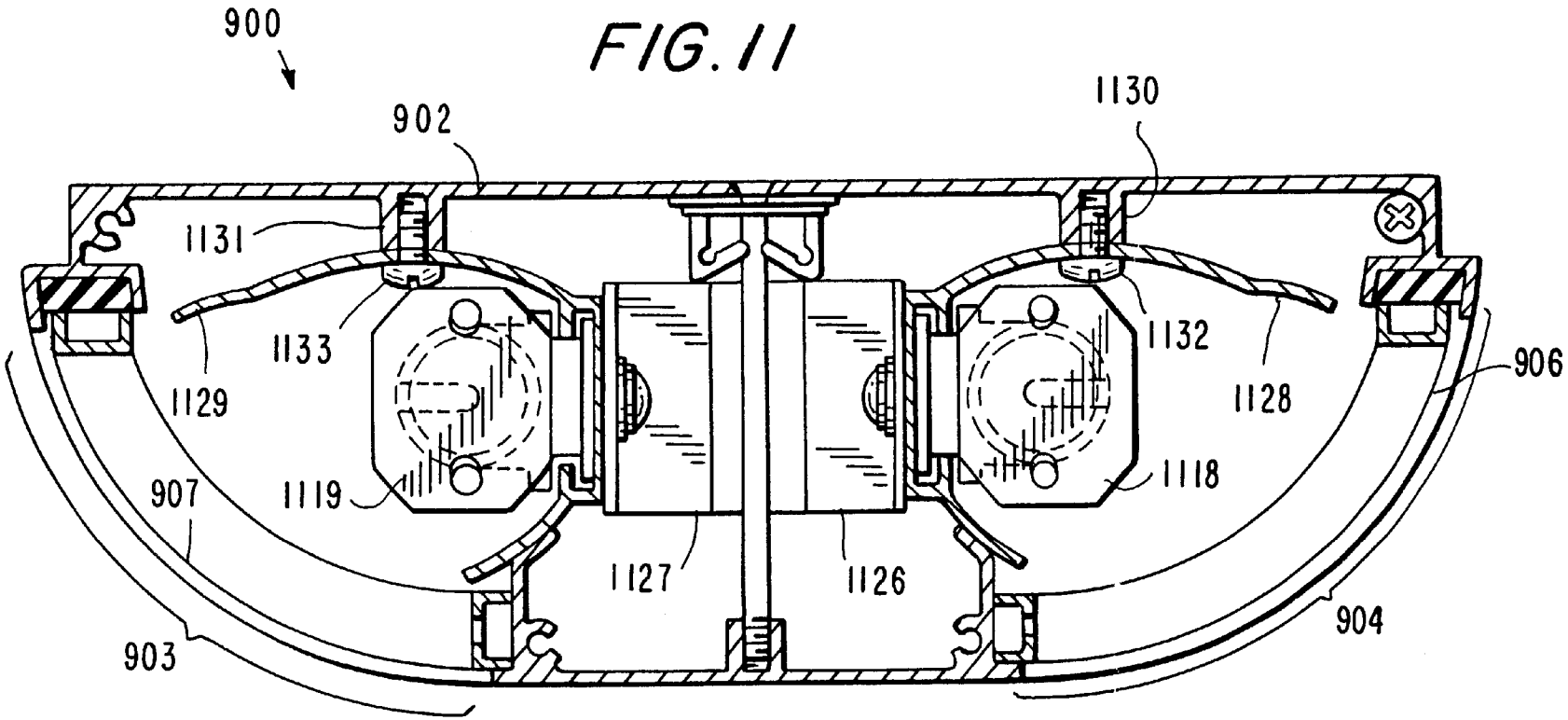
FIG. 11 is a cross-sectional view of the luminaire of FIG. 9 taken along line 11—11.

As shown in FIG. 11, luminaire 900 further includes lampholders 1118 and 1119, preferably electronic ballasts 1126 and 1127, independently adjustable reflectors 1128 and 1129, adjusting mechanisms 1130 and 1131, and screws 1132 and 1133, all enclosed within housing 902. Lampholders 1118 and 1119 each hold a fluorescent lamp, which is preferably a T5 fluorescent lamp. Adjusting mechanisms 1130 and 1131 alternatively can be other types of suitable adjusting mechanisms, such as, for example, hinged or pivoted adjusting mechanisms. And, reflectors 1128 and 1129 are each preferably adjustable in the same manner and to the same degree, and have the same advantages, as reflector 828 of luminaire 100. Furthermore, reflectors 1128 and 1129 are each adjustable independent of the other.

Figure 12:
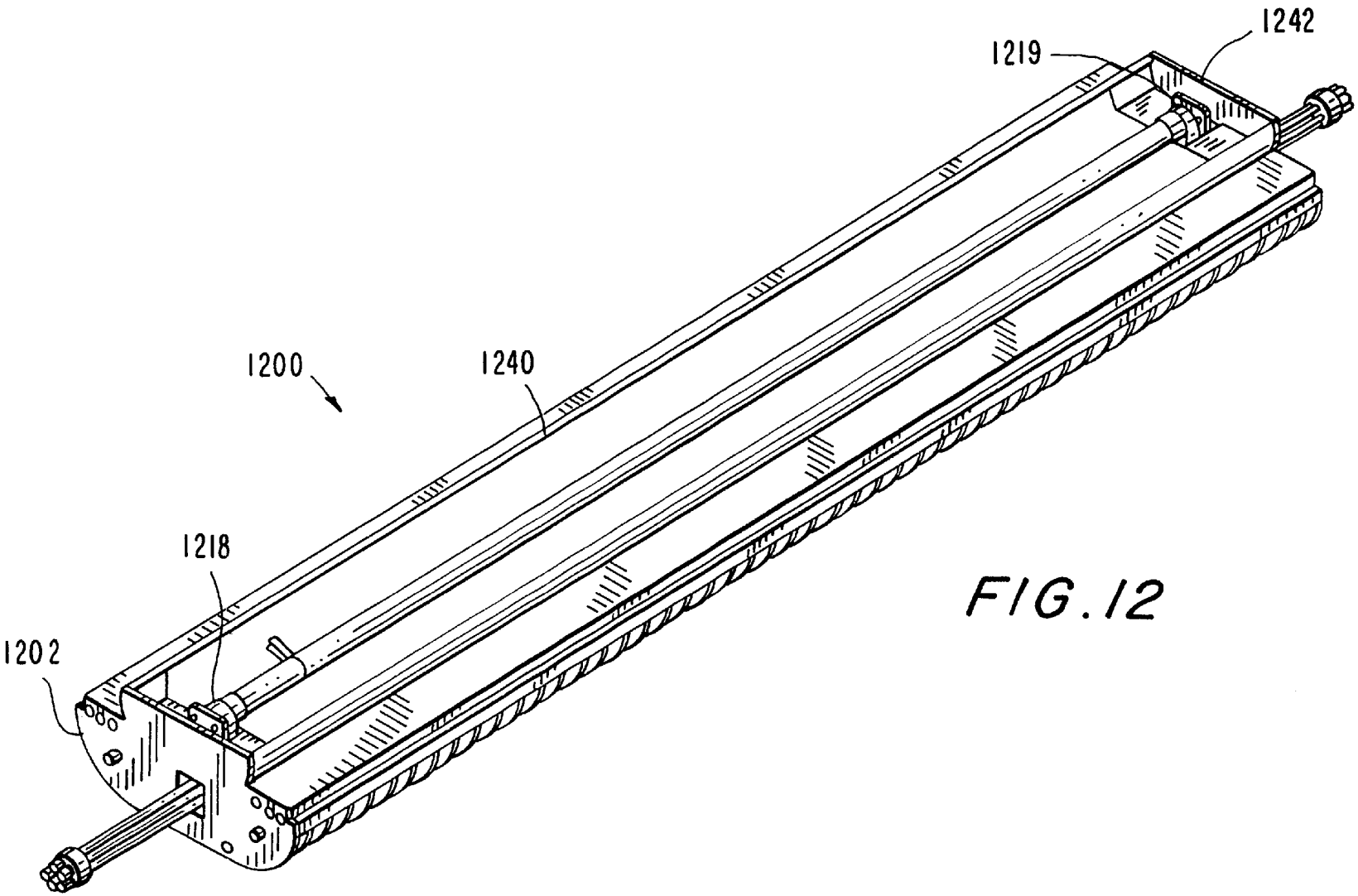
FIG. 12 is a perspective view of another embodiment of an asymmetric distribution luminaire in accordance with the invention.

FIG. 12 shows another embodiment of a linear asymmetrical luminaire in accordance with the invention. Luminaire 1200, which is similar to luminaire 900, includes an uplighting unit 1240. Uplighting unit 1240 has a pair of lampholders 1218 and 1219 mounted on an outside surface of housing 1202. Lampholders 1218 and 1219 hold preferably a T5 fluorescent lamp. Uplight reflector 1242 reflects light upward and outward to evenly illuminate, for example, a ceiling. Uplighting unit 1240 advantageously requires only a short setback distance from a surface to broadly "wash" that surface. Accordingly, luminaire 1200 is preferably installed a distance away from a ceiling to provide light in three general directions.

In another embodiment of the present invention (not shown), luminaire 100 has uplighting unit 1240 mounted on housing 102.

Luminaires of the present invention can be suspended (e.g., with cables from a ceiling or beam such that is the luminaire is a distance away from the ceiling or beam), surface mounted (e.g., directly to a ceiling or wall), cantilever-mounted (e.g., outward from a wall or shelving structure), or pendent or stem mounted (e.g., from a ceiling or other structure or surface such that the luminaire is a distance away from the ceiling or other structure or surface).

Luminaires of the present invention are particularly advantageous for illuminating the vertical surfaces of, for example, merchandise in stores and books in libraries, and the adjustability of their reflectors to particularly aim produced light further enhances their versatility.

Thus it is seen that linear asymmetric distribution luminaires having at least one adjustable reflector enclosed within the housing of the luminaire are provided. One skilled in the art will appreciate that the present invention can be practiced by other than the described embodiments, which are presented for purposes of illustration and not of limitation, and the present invention is limited only by the claims which follow.

We claim:

1. A linear luminaire comprising:

a housing having first and second apertures that each allow light from respective first and second sources to pass through;

a first baffle assembly mounted to said housing and positioned over said first aperture, said first baffle assembly including a plurality of parallel blades;

a second baffle assembly mounted to said housing and positioned over said second aperture, said second baffle assembly including a plurality of parallel blades;

a first reflector mounted within said housing, said first reflector having adjustable positions;

a first adjusting mechanism connected to said first reflector and mounted within said housing;

a second reflector mounted within said housing, said second reflector having adjustable positions; and a second adjusting mechanism connected to said second reflector and mounted within said housing; wherein:

positioning of said first and second reflectors are each independent of the other said reflector.

2. The luminaire of claim 1 wherein said first adjusting mechanism comprises a hinge.

3. The luminaire of claim 1 wherein said first adjusting mechanism includes a screw engaging said first reflector to secure said first reflector in one position and to release said first reflector for repositioning in another position.

4. The luminaire of claim 1 further comprising two pairs of lampholders mounted within said housing, each said pair to hold a T-5 fluorescent lamp.

5. The luminaire of claim 1 further comprising a pair of lampholders mounted on an outside surface of said housing, said pair to hold a fluorescent lamp.

6. A linear luminaire comprising:

a housing having first and second apertures that each allow light from respective first and second sources to pass there through;

a first baffle assembly mounted to said housing and positioned over said first aperture, said first baffle assembly including a plurality of parallel blades;

a second baffle assembly mounted to said housing and positioned over said second aperture, said second baffle assembly including plurality of parallel blades;

a first reflector mounted within said housing to reflect light through said first aperture, said first reflector having adjustable positions; and a second reflector mounted within said housing to reflect light through said second aperture, said second reflector having adjustable positions; wherein:

positioning of said first reflector is independent of said second reflector and positioning of said second reflector is independent of said first reflector.

7. The luminaire of claim 6 wherein said first reflector is adjustable about an axis substantially parallel to the longitudinal axis of said reflector.

8. The luminaire of claim 6 wherein said first reflector is adjustable through at least about 15° of rotation about an axis substantially parallel to the longitudinal axis of aid reflector.

9. The luminaire of claim 6 wherein said first baffle assembly is elliptically shaped.

10. The luminaire of claim 6 wherein said first baffle assembly is hinged to said housing to provide access to at least a portion of the inside of said housing via said first aperture when said first baffle assembly is in a first hinged position.

11. The luminaire of claim 6 wherein said housing includes at least one access hole at a longitudinal end of said housing to all w wiring to be routed there through and to permit side-by-side placement of another said luminaire with wiring running discreetly through and between said luminaires.

12. The luminaire of claim 6 further comprising a pair of lampholders to hold a fluorescent lamp, said lampholders mounted on an outside surface of said housing.

13. The luminaire of claim 6 further comprising a pair of lampholders to hold a fluorescent lamp, said lampholders mounted within said housing.

14. A linear luminaire comprising:

a housing having first and second apertures that each allows light from respective first and second sources to pass there through;

a first reflector mounted within said housing to reflect light through said first aperture, said first reflector having adjustable positions; and a second reflector mounted within said housing to reflect light through said second aperture, said second reflector having adjustable positions; wherein:

positioning of said first reflector is independent of said second reflector and positioning of said second reflector is independent of said first reflector;

light passing through said first aperture has substantially the same distribution shape regardless of said first reflector's position; and light passing through said second aperture has substantially the same distribution shape regardless of said second reflector's position.

* * * * *

UNITED STATES PATENT AND TRADEMARK OFFICE

CERTIFICATE OF CORRECTION

PATENT NO. : 6,652,118 B2
DATED : November 25, 2003
INVENTOR(S) : Sylvan R. Shemitz et al.

It is certified that error appears in the above-identified patent and that said Letters Patent is hereby corrected as shown below:

Column 1,
Line 17, change “having is higher” to -- having higher --.

Column 4,
Lines 20 and 22, change “150” to -- 15° --.

Column 5,
Line 28, change “that is the” to -- that the --.

Column 6,
Line 26, change “including plurality” to -- including a plurality --;
Line 42, change “of aid” to -- of said --; and
Line 53, change “all w wiring” to -- allow wiring --.

Signed and Sealed this

Twenty-fifth Day of May, 2004

JON W. DUDAS
*Acting Director of the United States Patent and Trademark Office*